US009302132B2

(12) United States Patent
Green et al.

(10) Patent No.: US 9,302,132 B2
(45) Date of Patent: Apr. 5, 2016

(54) SPRINKLER SKIPPING SHIELD WITH IMPROVED AIRFLOW

(75) Inventors: Brian S. Green, Nashville, MI (US); Lindsay M. Barker, Delton, MI (US)

(73) Assignee: The Viking Corporation, Hastings, MI (US)

( * ) Notice: Subject to any disclaimer, the term of this patent is extended or adjusted under 35 U.S.C. 154(b) by 1761 days.

(21) Appl. No.: 12/410,991

(22) Filed: Mar. 25, 2009

(65) Prior Publication Data

US 2010/0243283 A1 Sep. 30, 2010

(51) Int. Cl.

| | |
|---|---|
| ***A62C 37/08*** | (2006.01) |
| ***A62C 37/12*** | (2006.01) |
| ***A62C 31/02*** | (2006.01) |
| ***A62C 35/68*** | (2006.01) |

(52) U.S. Cl.

CPC ..... *A62C 37/12* (2013.01); *A62C 31/02* (2013.01); *A62C 35/68* (2013.01)

(58) Field of Classification Search

CPC ..... A62C 35/68; A62C 37/12; A62C 31/02
USPC ..... 169/37, 38, 39, 41, 56, 57, 58, 59, 91; 239/288, 288.3, 288.5

See application file for complete search history.

(56) References Cited

U.S. PATENT DOCUMENTS

| | | | | |
|---|---|---|---|---|
| 2,213,527 | A | 9/1940 | Lowe | |
| 3,454,097 | A | 7/1969 | Groos | |
| 4,014,388 | A * | 3/1977 | Anderson | 169/37 |
| 4,274,591 | A * | 6/1981 | Sunshine et al. | 239/722 |
| 4,804,503 | A * | 2/1989 | Komiya | 261/153 |
| 5,080,176 | A * | 1/1992 | Polan et al. | 169/37 |
| 5,097,906 | A * | 3/1992 | Polan | 169/37 |
| 5,372,203 | A * | 12/1994 | Galaszewski | 169/37 |
| 5,447,338 | A * | 9/1995 | Kikuchi | 285/46 |
| 6,641,059 | B2 | 11/2003 | Waligorski | |
| 7,275,603 | B2 * | 10/2007 | Polan | 169/37 |
| 7,699,116 | B2 * | 4/2010 | de Ris et al. | 169/37 |
| 2009/0151962 | A1 * | 6/2009 | de Ris et al. | 169/37 |

* cited by examiner

*Primary Examiner* — Jason Boeckmann

(74) *Attorney, Agent, or Firm* — Harness, Dickey & Pierce, P.L.C.

(57) ABSTRACT

A fire protection sprinkler is provided with a skipping shield having air flow passages therethrough to reduce the negative impact that the shield has on the thermal response of the sprinkler. By providing holes, slots, louvers, or mesh to the skipping shield, water from adjacent flowing sprinklers can still be blocked from impinging on the thermal element. The shield will block water but allow hot gas from the fire to flow through the shield thereby improving the response time of the thermal element.

12 Claims, 6 Drawing Sheets

FIG 1
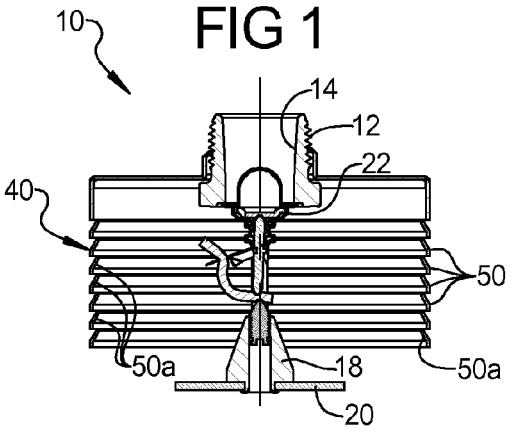
FIG 2
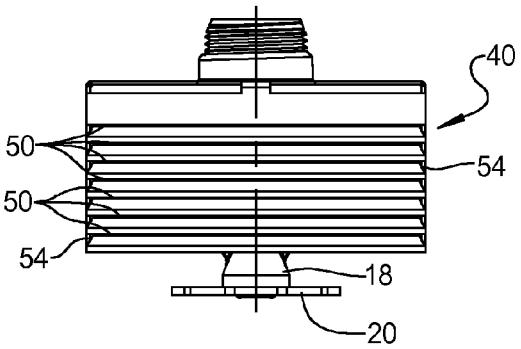
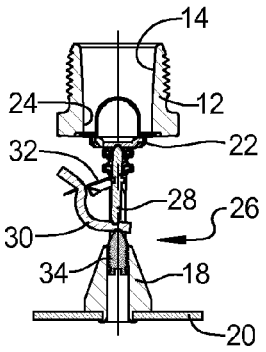
FIG 3
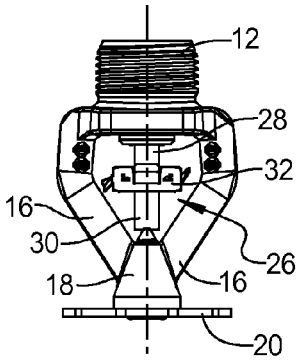
FIG 4

FIG 5
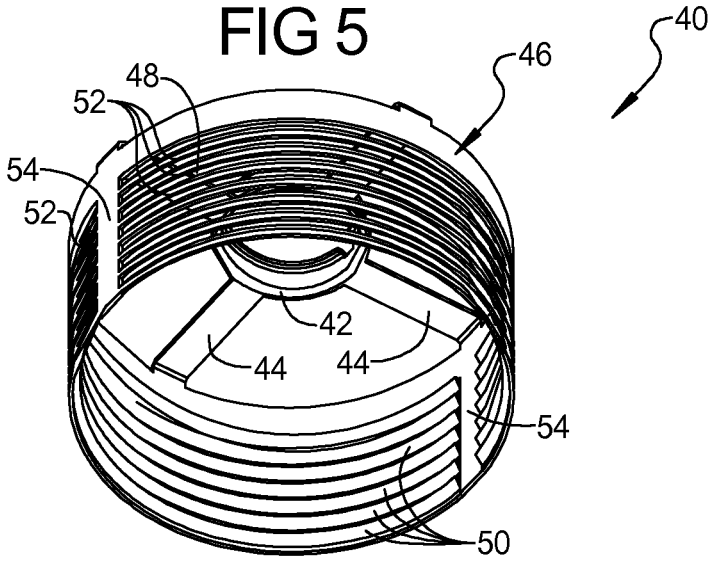
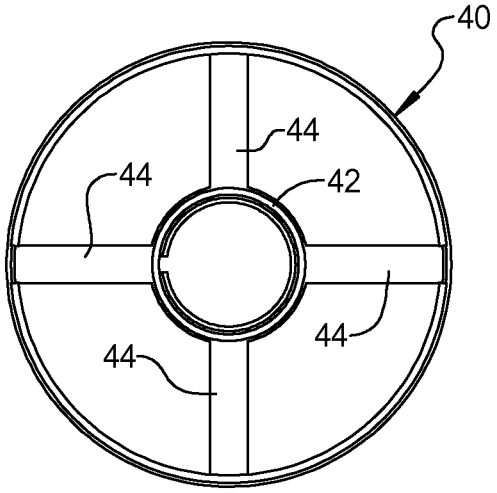
FIG 6

FIG 7
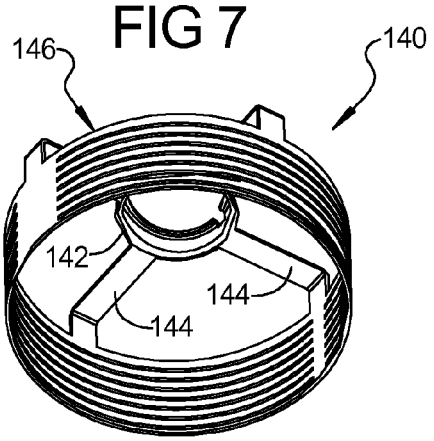
FIG 8
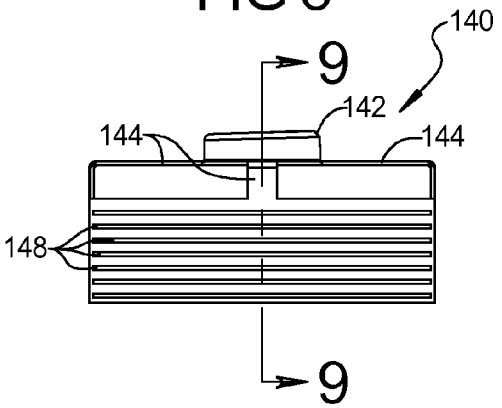
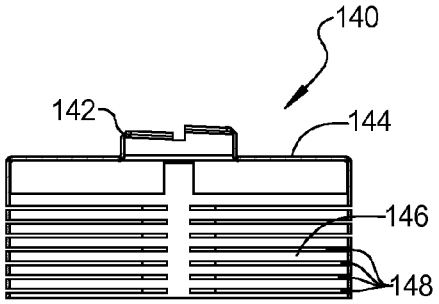
FIG 9
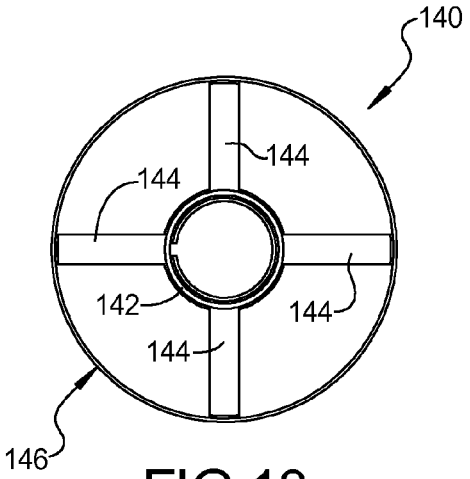
FIG 10

FIG 11
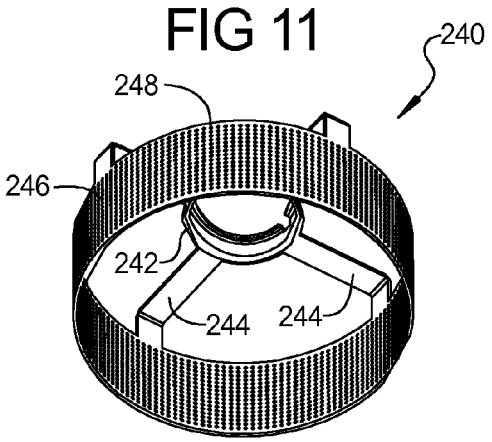
FIG 12
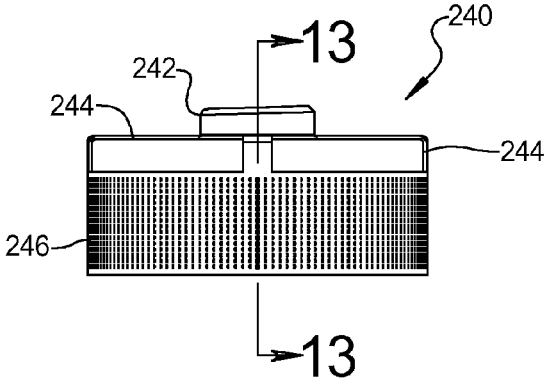
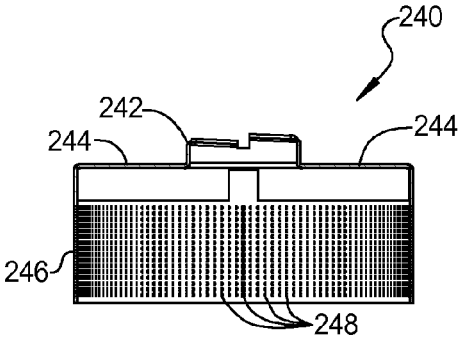
FIG 13
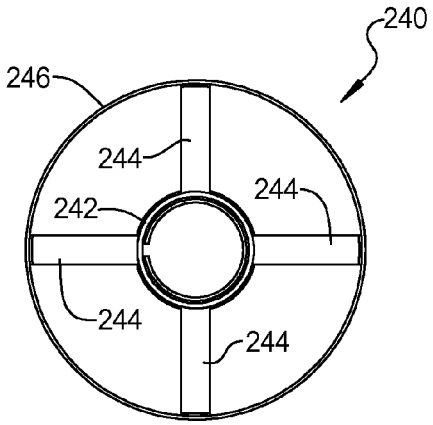
FIG 14

FIG 15
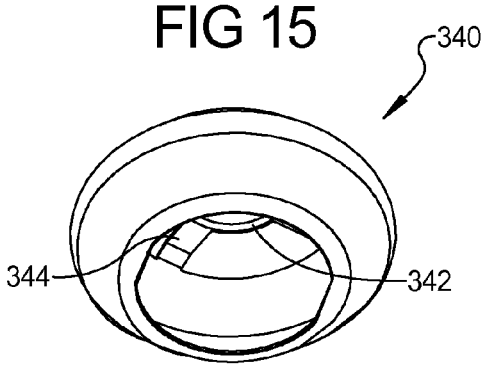
FIG 16
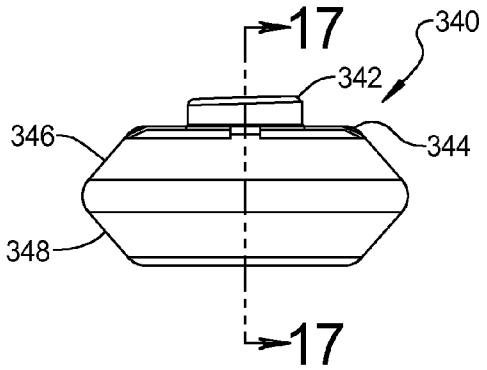
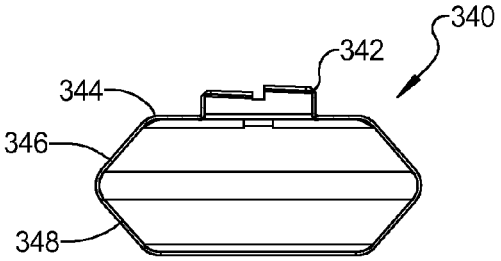
FIG 17
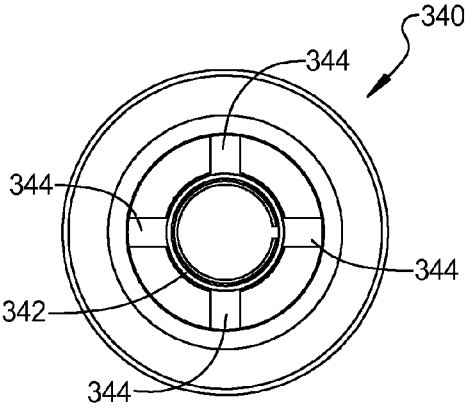
FIG 18

SPRINKLER SKIPPING SHIELD WITH IMPROVED AIRFLOW

FIELD

The present disclosure relates to fire protection sprinklers, and more particularly to a fire protection sprinkler having a sprinkler skipping shield with improved airflow.

BACKGROUND AND SUMMARY

This section provides background information related to the present disclosure which is not necessarily prior art.

Sprinkler skipping is a behavior that is sometimes exhibited by an array of sprinklers during a full scale fire. Typically, a fire will initially set off one to four sprinklers in quick succession depending where the ignition source is in relation to the sprinkler array. These first few activations are usually defined as the first ring of activated sprinklers. As hot gas from the fire spreads radially outward from the center, the hot gas comes in contact with the second ring of sprinklers. The second ring of sprinklers are radially adjacent to the first ring. The next consecutive/adjacent ring would be the third ring, and the next would be the fourth ring and so on. Sprinkler skipping occurs when a sprinkler in the third or fourth ring operates before a sprinkler in the second ring. In more general terms, skipping is when a non-activated sprinkler adjacent to a flowing sprinkler fails to operate before sprinklers that are farther away from the heat source. This behavior results in the sprinkler array not performing to its highest efficiency.

Some members of the fire protection industry have concluded that water impingement is the cause of sprinkler skipping. Water impingement is defined as (1) water flow from an activated sprinkler to an adjacent sprinkler; or (2) water droplets carried by the fire plume on to an adjacent sprinkler and impinging on that sprinklers thermal element. The water impingement absorbs heat from the thermal element preventing or retarding its activation (the water keeps the thermal element below its operating temperature).

In order to prevent water impingement, it has been proposed that a shield be installed such that water traveling from a flowing sprinkler or water carried by the fire plume will not strike the thermal element of an adjacent sprinkler. This, in theory, prevents the thermal element from becoming wetted, thereby preventing skipping. The shield that has been proposed is of a solid cylindrical construction.

There is some concern that the response time of the thermal element will be impeded by the skipping shield. The impeded response time can negatively impact the performance of a sprinkler in a fire and in a "Response Time Index" plunge oven test. Both of these tests are important to the performance of the sprinkler in terms of gaining Approvals and Listings.

The present disclosure provides improvements to the design of the skipping shield to reduce the negative impact that the shield has on the thermal response of the sprinkler. By adding holes, slots, louvers, or mesh to the skipping shield, water from the flowing head can still be blocked from impinging on the thermal element. The improved shield will block water from impinging on the heat responsive element but will allow hot gas from the fire to flow through the shield thereby improving the response time of the thermal element.

The present disclosure also provides a geometrical shape other than the cylindrical shape. The improved geometrical shape is designed in such a fashion to encourage laminar or turbulent gas flow around the shield and onto the thermal element of the sprinkler. The shape is made such that water impinges on the shield, yet provides improvement to the airflow that lowers the response time index as compared to that of previous skipping shield designs.

The present disclosure also includes the combination of holes, slots, louver, or mesh with a geometric shape that promotes improved air flow around the thermal element.

Compared to previously proposed skipping shield designs, the improved skipping shield will yield better sprinkler performance in fires by enhancing the response time. The improved skipping shield will also reduce the RTI (Response Time Index) when tested in a plunge oven.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a cross-sectional view of a fire protection sprinkler according to the principles of the present disclosure;

FIG. 2 is a side view of the fire protection sprinkler of FIG. 1;

FIG. 3 is a cross-sectional view of a fire protection sprinkler with the shield removed;

FIG. 4 is a side view of the fire protection sprinkler of FIG. 3;

FIG. 5 is a perspective view of the skipping shield shown in FIG. 1;

FIG. 6 is a top view of the skipping shield shown in FIG. 5;

FIG. 7 is a perspective view of an alternative skipping shield;

FIG. 8 is a side view of the skipping shield shown in FIG. 7;

FIG. 9 is a cross-sectional view taken along line 9-9 of FIG. 8;

FIG. 10 is a top view of the skipping shield shown in FIG. 7;

FIG. 11 is a perspective view of a further alternative skipping shield;

FIG. 12 is a side view of the skipping shield shown in FIG. 11;

FIG. 13 is a cross-sectional view taken along line 13-13 of FIG. 12;

FIG. 14 is a top view of the skipping shield shown in FIG. 11;

FIG. 15 is a perspective view of a still further alternative skipping shield;

FIG. 16 is a side view of the skipping shield shown in FIG. 15;

FIG. 17 is a cross-sectional view taken along line 17-17 of FIG. 16;

FIG. 18 is a top view of the skipping shield shown in FIG. 15; and

Corresponding reference numerals indicate corresponding parts throughout the several views of the drawings.

DETAILED DESCRIPTION

Figure 19:
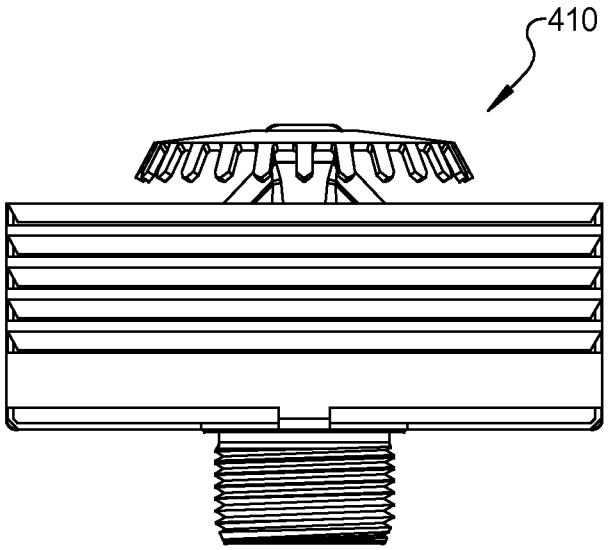
FIG. 19 is a side view of an upright fire protection sprinkler having a skipping shield according to the principles of the present disclosure.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.).

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-6, a fire protection sprinkler 10 according to the principles of the present disclosure will now be described. The fire protection sprinkler 10 includes a body 12 including a fluid passage 14 extending therethrough. The sprinkler 10 can be an upright or pendent sprinkler. A pair of frame arms 16, can extend from the body 12 and converge at an apex 18. A deflector 20 can be mounted to the apex 18. A plug assembly 22 can be disposed in the outlet end 24 of the fluid passage 14. A heat responsive trigger assembly 26 or other head responsive unit can be utilized for supporting the plug assembly 22 in the outlet of the fluid passage 14. As illustrated, the heat responsive trigger assembly 26 can include a support strut 28, a trigger arm 30 and a heat responsive soldered link 32. A set screw 34 can be provided in the apex 18 for engaging the heat responsive trigger assembly 26 in an assembled condition. It should be noted that other heat responsive units can be utilized including glass bulb and other types of heat responsive triggers.

The sprinkler body 12 can be provided with any discharge K factor for a desired application. The heat responsive trigger assembly 26 can have any desired response temperature rating and the sprinkler 10 can be designed to have any desired response time index (RTI) for a desired application.

A shield 40 is mounted to the sprinkler body 12 and can include an interior hub portion 42 which can optionally be threadedly engaged with the external threads on the sprinkler body 12. The shield can be mounted to sprinkler body 12 via the frame arms, via the deflector, or via other exterior structure such as a supply piping or other ceiling structures. A plurality of radial spokes 44 can extend from the hub portion 42 for supporting the shield body 46. The spokes 44 can include spaces therebetween to facilitate airflow therebetween. The shield body can include a cylindrical wall portion 48. The wall portion 48 can have other shapes such as cone shaped and sphere shaped, and can be ellipse, square or rectangle in cross-section and can include continuous or discontinuous wall sections. The shield body 48 can include a plurality of louvers 50 that allow air flow through the shield body 46. The louvers 50 can include an inwardly bent portion **50*a* that define air passages 52 that allow heated air from a fire to enter the shield 40 while the shield serves to prevent water droplets from entering the shield and contacting the heat responsive trigger assembly 26. It is noted that the louvers 50 can extend around a majority of the shield and the louvers 50 can be connected by one or more web portion 54. The louvers can be vertical or horizontal in an assembled condition. The spaces 52 between louvers 50 can be between 0.01 and 1 inch, and more specifically between 0.02 and 0.5 inches. The shield 40 can be formed in a generally cup-shape and the openings between the spokes 44 additionally provide for air circulation into and out of the shield body 46**.

With reference to FIGS. 7-10, an alternative shield arrangement 140 is provided wherein the shield body 146 is provided with a plurality of slots 148 which can extend around a majority of the shield body 146. As shown in FIGS. 7-10, the shield body 146 can be cylindrical in form, cone shaped, and spherical shaped and can be elliptical, rectangular, square in cross-section, or can include other geometric shapes. The slots 148 can be horizontal or vertical and can have a width between 0.01 inches and 1 inch, and more specifically between 0.01 and 0.5 inches. The slots 148 and the shield body 146 allow air flow through the shield 140 so as to allow rapid response to a fire while still protecting the heat responsive trigger assembly from water droplets from adjacent sprinkler heads.

With reference to FIGS. 11-14, a further alternative embodiment of the shield 240 is shown including a shield body 246 includes a plurality of holes 248 extending therethrough. The holes 248 can be round, square, rectangular, oval or other geometric shapes. The holes can have a diameter from between 0.002 inches to 1 inch, and more specifically from 0.002 to 0.5 inches, depending upon the spacing therebetween. The plurality of holes 248 allow airflow through the shield while blocking water droplets from engaging the heat responsive trigger assembly. As a still further alternative, the shield body 246 can be formed by a mesh.

With reference to FIGS. 15-18, a generally bulb-shaped shield 340 is shown as an alternative shield geometry. The bulb-shaped shield 340 can include a partially spherical body, or alternatively, cone shaped upper and lower wall section 346, 348 that are supported by spokes 344 which extend radially outward from a central hub 342. It should be understood that the shield 340 can further include holes, slots, louvers or mesh (as described above) to further facilitate air flow through the shield into the heat responsive trigger assembly.

With reference to FIG. 19, it is noted that the shield designs disclosed herein can be utilized with an upright sprinkler 410 as shown. The shield design can be arranged so as not to affect the water distribution pattern of the sprinkler 410.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A fire protection sprinkler, comprising:
a body including a fluid passage therethrough;
a pair of frame arms extending from said body;
a deflector mounted to said pair of frame arms;
a heat responsive trigger supporting a plug member over an outlet of said fluid passage;
a cylindrical shield surrounding said heat responsive trigger, said cylindrical shield having a proximal terminal edge and a distal terminal edge and including means disposed between said proximal and distal terminal edges of said cylindrical shield for allowing airflow through said cylindrical shield; and
a plurality of spaced support arms each having a first portion extending axially from said proximal terminal edge of said cylindrical shield and including a second portion extending radially inward from said first portion and connected to a ring that is received around said body for supporting said cylindrical shield to said body.

2. The fire protection sprinkler according to claim 1, wherein said shield completely surrounds said heat responsive trigger.

3. The fire protection sprinkler according to claim 1, wherein said sprinkler is a pendant-type sprinkler and said shield is spaced above said deflector when said sprinkler is assembled.

4. The fire protection sprinkler according to claim 1, wherein said shield is disposed radially outward of said pair of frame arms.

5. The fire protection sprinkler according to claim 1, wherein said sprinkler is an upright-type sprinkler.

6. A fire protection sprinkler, comprising:
a body including a fluid passage therethrough;
a pair of frame arms extending from said body;
a deflector mounted to said pair of frame arms;
a heat responsive trigger supporting a plug member over an outlet of said fluid passage; and
a shield at least partially surrounding said heat responsive trigger and including a plurality of louvers therein for allowing airflow through said shield, said plurality of louvers being horizontally oriented when said sprinkler is in a vertical, assembled condition, wherein said louvers each extend in a circumferential direction around said shield from at least one axially extending vertical web portion.

7. The fire protection sprinkler according to claim 6, wherein said shield completely surrounds said heat responsive trigger.

8. The fire protection sprinkler according to claim 6, wherein said shield is cylindrical.

9. The fire protection sprinkler according to claim 6, wherein said sprinkler is a pendant-type sprinkler and said shield is spaced above said deflector when said sprinkler is assembled.

10. The fire protection sprinkler according to claim 6, wherein said shield includes a plurality of spaced support arms extending radially inward for supporting said shield to said body.

11. The fire protection sprinkler according to claim 6, wherein said sprinkler is an upright-type sprinkler.

12. The fire protection sprinkler according to claim 6, wherein an upper edge of said plurality of louvers are disposed radially inward from a lower edge thereof.

* * * * *